US010415807B2

(12) United States Patent
Dietrich

(10) Patent No.: US 10,415,807 B2
(45) Date of Patent: Sep. 17, 2019

(54) ELECTRONIC DEVICE FOR INSTALLING IN A SWITCH CABINET, WHICH ELECTRONIC DEVICE HAS A FIRST AND A SECOND FASTENER

(71) Applicant: RITTAL GMBH & CO. KG, Herborn (DE)

(72) Inventor: Christian Dietrich, Mittenaar-Offenbach (DE)

(73) Assignee: Rittal GmbH & Co. KG (DE)

( * ) Notice: Subject to any disclaimer, the term of this patent is extended or adjusted under 35 U.S.C. 154(b) by 0 days.

(21) Appl. No.: 16/082,312

(22) PCT Filed: Apr. 6, 2017

(86) PCT No.: PCT/DE2017/100272
§ 371 (c)(1),
(2) Date: Sep. 5, 2018

(87) PCT Pub. No.: WO2017/178010
PCT Pub. Date: Oct. 19, 2017

(65) Prior Publication Data

US 2019/0086063 A1 Mar. 21, 2019

(30) Foreign Application Priority Data

Apr. 15, 2016 (DE) ..... 10 2016 107 044

(51) Int. Cl.
*F21V 17/02* (2006.01)
*F21V 5/04* (2006.01)
(Continued)

(52) U.S. Cl.
CPC ..... *F21V 21/26* (2013.01); *A47B 97/00* (2013.01); *F21V 17/002* (2013.01); *F21V 17/10* (2013.01);
(Continued)

(58) Field of Classification Search
CPC ..... F21V 21/26; F21V 33/0012; F21V 23/06; F21V 21/02; F21V 17/10; F21V 17/002;
(Continued)

(56) References Cited

U.S. PATENT DOCUMENTS 9,608,315 B2 3/2017 Gerneth et al.
9,743,538 B2 8/2017 Mickmann
(Continued)

FOREIGN PATENT DOCUMENTS

CN 204164804 U 2/2015
DE 2428518 A1 12/1975
(Continued)

OTHER PUBLICATIONS

International Search Report (in English and German) and Written Opinion (in German) issued in PCT/DE2017/100272, dated Jun. 22, 2017; ISA/EP.

*Primary Examiner* — Tracie Y Green
(74) *Attorney, Agent, or Firm* — Harness, Dickey & Pierce, PLC

(57) ABSTRACT

The invention relates to an electronic device with a device base for mounting the electronic device on a support, wherein at least one pivot arm is partially taken up in a receptacle of the device base and partially protrudes from the device base, which arm is adjustable about a pivot axis parallel to a contact side of the device base, wherein, in a first setting position of the pivot arm, a first attachment means is arranged outside the receptacle and wherein, in a second setting position of the pivot arm, a second attachment means differing from the first attachment means is arranged outside the receptacle, characterized in that a recess opening into the receptacle is formed on a side wall of the device base, into which recess a locking piece is inserted, which is adjustable between a release position, in which it releases the pivot arm, and a locking position, in which it fixes the
(Continued)

pivot arm optionally in the first or in the second setting position. The electronic device can be a control cabinet lamp in particular.

13 Claims, 7 Drawing Sheets

(51) Int. Cl.

| | |
|---|---|
| ***F21V 21/26*** | (2006.01) |
| ***F21V 17/00*** | (2006.01) |
| ***F21V 17/10*** | (2006.01) |
| ***F21V 21/02*** | (2006.01) |
| ***A47B 97/00*** | (2006.01) |
| ***F21V 23/06*** | (2006.01) |
| ***F21V 33/00*** | (2006.01) |
| *F21W 131/301* | (2006.01) |

(52) U.S. Cl.
CPC ..... *F21V 21/02* (2013.01); *F21V 23/06* (2013.01); *F21V 33/0012* (2013.01); *A47B 2220/0077* (2013.01); *F21W 2131/301* (2013.01)

(58) Field of Classification Search
CPC ..... A47B 97/00; A47B 2220/0077; F21W 2131/301
See application file for complete search history.

(56) References Cited

U.S. PATENT DOCUMENTS

| | | | | |
|---|---|---|---|---|
| 2008/0002415 | A1 | 1/2008 | Henkel | |
| 2014/0043193 | A1 | 2/2014 | Gerneth et al. | |
| 2016/0286666 | A1 | 9/2016 | Mickmann | |
| 2017/0261185 | A1 | 9/2017 | Hoffmeister | |
| 2019/0063725 | A1* | 2/2019 | Premysler | F21V 17/002 |

FOREIGN PATENT DOCUMENTS

| | | | |
|---|---|---|---|
| DE | 102012207438 | A1 | 11/2012 |
| DE | 102013111551 | B3 | 1/2015 |
| DE | 102014013658 | A1 | 3/2016 |
| EP | 1873403 | B1 | 1/2013 |

* cited by examiner

ELECTRONIC DEVICE FOR INSTALLING IN A SWITCH CABINET, WHICH ELECTRONIC DEVICE HAS A FIRST AND A SECOND FASTENER

CROSS-REFERENCE TO RELATED APPLICATIONS

This application is a 371 U.S. National Stage of International Application No. PCT/DE2017/100272, filed on Apr. 6, 2017, which claims priority to German Application No. 10 2016 107 044.0, filed Apr. 15, 2016. The entire disclosures of the above applications are incorporated herein by reference.

FIELD

The invention starts out from an electronic device, in particular a control cabinet lamp, for installation in a control cabinet with a device base for mounting the electronic device on a support, wherein at least one pivot arm is partially taken up in a receptacle of the device base and partially protrudes from the device base, which arm is adjustable about a pivot axis parallel to a contact side of the device base, wherein in a first setting position of the pivot arm a first attachment means is arranged outside the receptacle, and wherein in a second setting position of the pivot arm a second attachment means differing from the first attachment means is arranged outside the receptacle. Such an electronic device formed as a control cabinet lamp is known from EP 1 873 403 B1.

BACKGROUND

This section provides background information related to the present disclosure which is not necessarily prior art.

In the arrangement of a control cabinet lamp in the interior of the control cabinet, for example, the exact location and the exact nature of the arrangement of the control cabinet lamp have frequently been subordinate to the space requirement of the components arranged in the interior of the control cabinet, so that in particular no fixed mounting location exists for the control cabinet lamp and this must be determined individually in each specific application. The control cabinet lamp can also not be arranged everywhere in the interior of the control cabinet. From its mounting location it must, for example, be able to guarantee reasonable illumination of the control cabinet interior and its mounting location must permit cable routing of the power supply cable of the control cabinet lamp that does not obstruct access to the interior of the control cabinet. The control cabinet lamp must further be arranged so that it does not obstruct the cooling air circulation provided by a cooling device inside the control cabinet, and not least the control cabinet lamp must be arranged so that a light or movement sensor of the control cabinet lamp is oriented facing the control cabinet door or at least the control cabinet interior for activating the control cabinet lamp.

The electronic device must therefore be prepared to be able to adapt individually to the very different mounting conditions, so that it should have different attachment means, for example, to permit mounting on a frame section of the control cabinet on the one hand, for instance, and on the other hand to permit mounting on a flat part of the control cabinet, on the mounting plate or on the base plate of a roof-mounted cooling unit.

SUMMARY

This section provides a general summary of the disclosure, and is not a comprehensive disclosure of its full scope or all of its features.

The aspect of the invention is therefore to propose an electronic device of the type described at the beginning, which is prepared for flexible mounting using different attachment means and is kept as simple as possible in design terms in order to facilitate cost-effective manufacture. Furthermore, the device to be proposed should be formed so that at least one of the different attachment means permits equipotential bonding between the unit and the support on which the unit is mounted, at least in one embodiment.

It is provided accordingly that a recess opening into the receptacle is formed on a side wall of the device base, into which recess a locking piece is inserted, which is adjustable parallel to the pivot axis between a release position, in which it releases the pivot arm, and a locking position, in which it fixes the pivot arm optionally in the first or the second setting position.

The pivot arm can be a freely movable, axially supported metal molding, which has the first and the second attachment means perpendicular to the pivot axis at opposite ends on both sides of the pivot axis. Such a pivot arm can be a punched molding. The pivot arm can be supported in opposing side walls of the device base, for which these bearing receptacles, for example in the form of holes, are formed on opposing inner sides of the side walls of the device base, which delimit the receptacle of the device base.

The locking piece can be a plastic molding, in particular an injection molding, which in a release position, in which it protrudes at least partially out of the recess in the side wall of the device base, releases the pivot arm to the extent that it is freely adjustable about its pivot axis between its two setting positions. The locking piece can have at least one attachment means receptacle, in particular at least one form-fit receptacle, on its end facing the device base, wherein the at least one receptacle for an attachment means is adapted to the contour of one of the two attachment means and wherein if necessary the second attachment means receptacle, if present, is adapted to the contour of the other attachment means. Depending on the setting of the pivot arm, the respective attachment means that does not protrude from the device base is consequently taken up in the receptacle of the device base, in the respective (form-fit) receptacle in the first or the second setting position of the pivot arm, so that the pivot arm is fixed immovably in one or the other setting position.

The at least one receptacle for an attachment means can have a run-up slope, in order to pretension the pivot arm in the first or the second setting position. If at least one of the attachment means is a hook element with contact claws, for example, contacting of the hook element with the support, for example a painted metal section frame of a control cabinet, can be facilitated by the pretensioning of the hook element, in order to create equipotential bonding between the attachment means and the support.

The first attachment means can be formed for the tool-dependent attachment of the electronic device to the support, for example, while the second attachment means is formed for the tool-free attachment of the control cabinet lamp to the support. For the tool-dependent attachment, the first attachment means can be formed as a bolt receptacle, outlet opening or eye, for example. For the tool-free attachment, the second attachment means can be formed as a hook element, for example. The first or the second attachment means can have contact claws, in order to improve the contacting between the attachment means and the support of the electronic device.

The pivot arm can be manufactured from an electrically conductive material, in particular from a metal, and also be connected electrically to a protective conductor of the electronic device. The electrical contacting between the pivot arm and the device base can take place, for example, via bearing extension pieces of the pivot arm, via which the pivot arm is supported pivotably in bearing receptacles on the device base. However, it can also be provided that the pivot arm electrically contacts a contact in the receptacle of the device base at least or exclusively in the first and/or second setting position, which contact is connected electrically to the protective conductor, for example via an electrical conductor.

For example, a contact ridge of one of the two attachment means molded in one piece onto the pivot arm can electrically contact the contact when the pivot arm is located in the setting position in which the other attachment means protrudes from the receptacle. For example, a contact ridge of the second attachment means can contact the contact electrically when the pivot arm is located in the first setting position and the first attachment means is arranged outside the receptacle. The contact can be formed as a flexible contact spring sheet, for example.

The pivot arm can be supported in the receptacle of the device base in various ways. A variant that is simple in design and thus low-cost provides that the pivot arm has two bearing extension pieces opposing one another, which each engage in a bearing receptacle in the device base and form the pivot axis. In this case the first and the second attachment means can be molded opposingly onto the pivot axis perpendicular to the pivot axis.

One of the attachment means can be formed as a substantially S-shaped hook element, while the other attachment means is an attachment eye, for example a through hole in a mounting flange.

The locking piece can assume a latching position in the locking position and press the pivot arm into the fixed setting position with pretensioning. Furthermore, the locking piece can assume another latching position in the release position, in order to identify the release of the pivot arm haptically.

The locking piece can act in the locking position on the attachment means of the pivot arm that is arranged inside the receptacle. Furthermore, the locking piece can close at least the recess on the side wall and an access to the receptacle on an end face of the device base in the locking position. This is not only aesthetically advantageous, as it takes care of the required IP protectability in the control cabinet construction, and also guarantees operational security in that it prevents a person from inadvertently reaching into the receptacle.

It can further be provided that the pivot arm can be fixed by way of the locking piece in at least two different locking positions, in order to permit an adaptation of the orientation of the attachment means to a given geometry of the support.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

The electronic device is not restricted to any definite embodiments. According to a conceivable embodiment, the electronic device is a control cabinet lamp for mounting inside a control cabinet. Different embodiments of such a control cabinet lamp and other details of the invention are explained with reference to the figures below. In these:

DETAILED DESCRIPTION

Example embodiments will now be described more fully with reference to the accompanying drawings.

Figure 1:
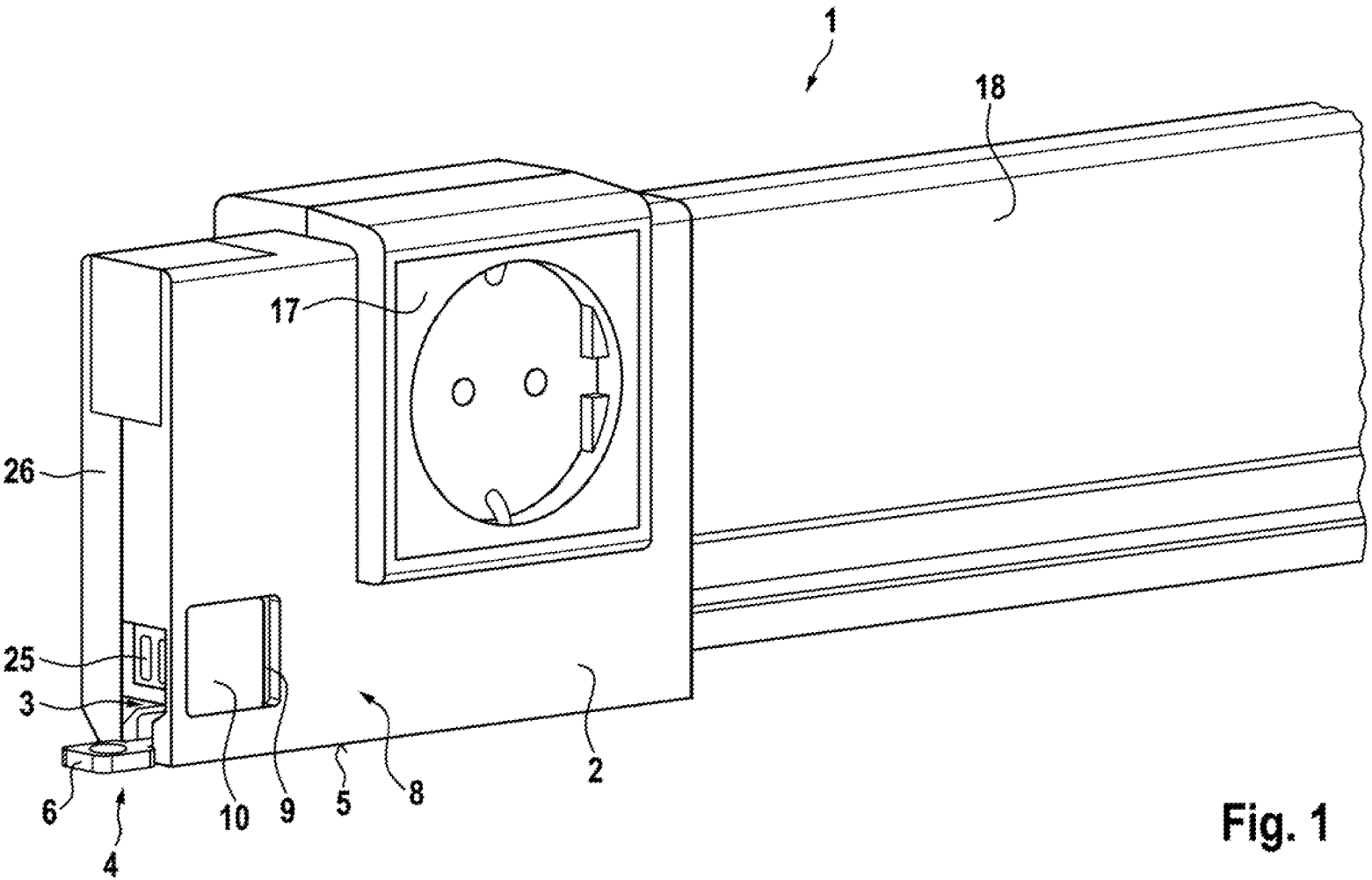
FIG. 1 shows a view in perspective of an embodiment of a control cabinet lamp, in which the pivot arm is arranged in the first setting position.
Figure 2:
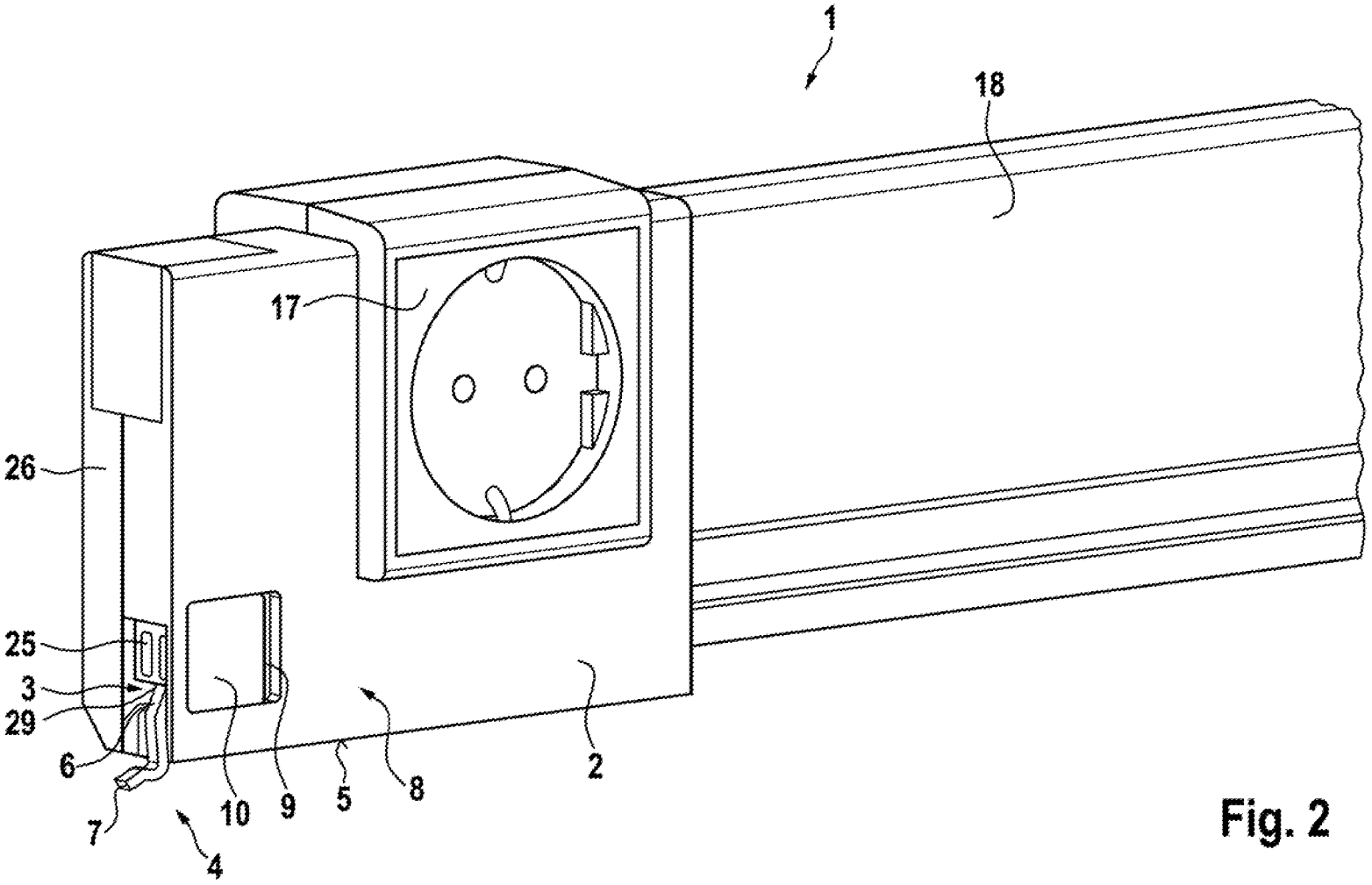
FIG. 2 shows the embodiment according to FIG. 1, wherein the pivot arm is arranged in the second setting position.
Figure 3:
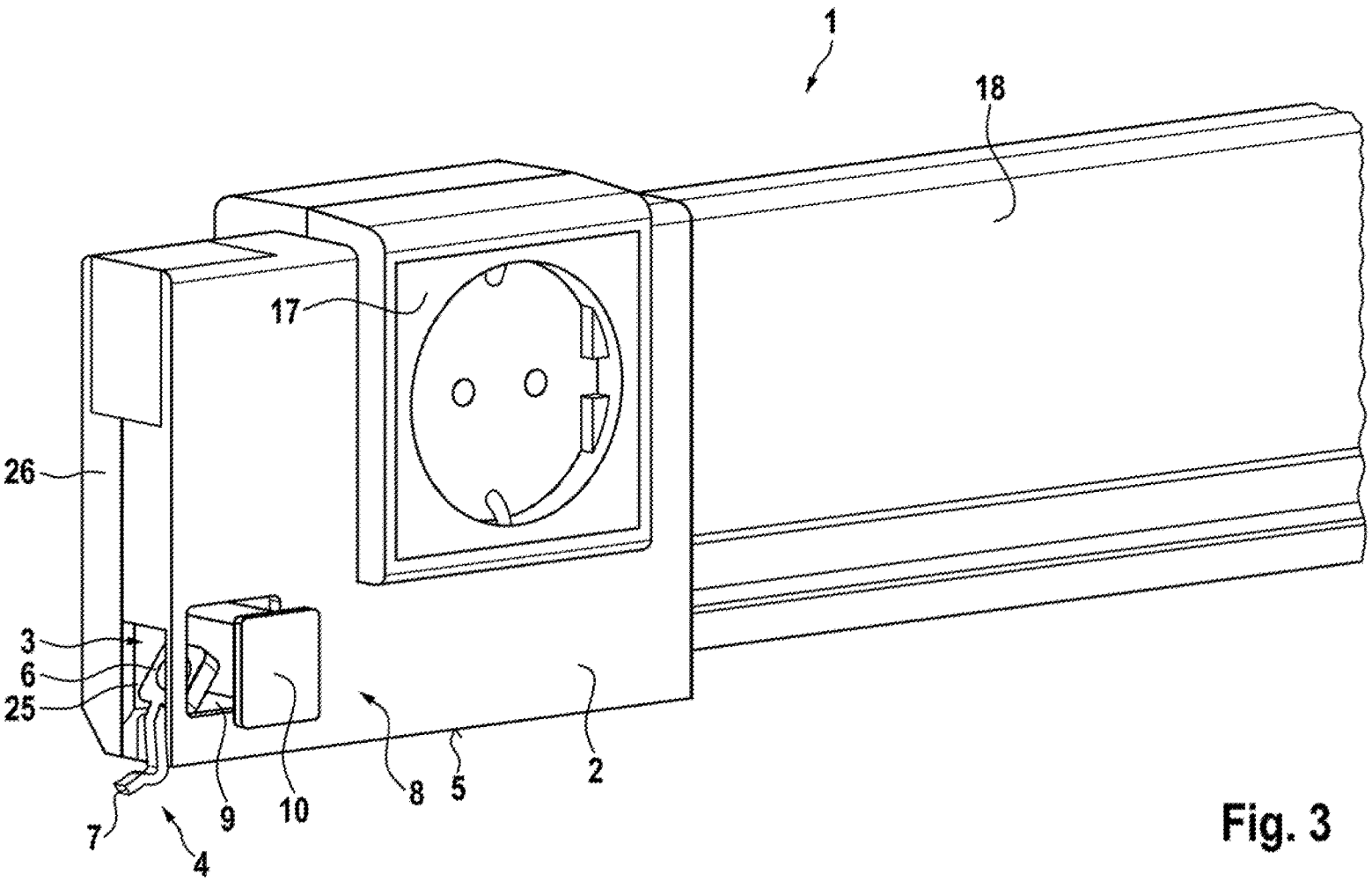
FIG. 3 shows the embodiment according to FIG. 2, wherein the locking piece is located in the release position.

FIGS. 1-3 show an exemplary embodiment of an inventive control cabinet lamp 1 with a view onto the device base on the end face formed as a lamp base 2, in which, for example, substantial components of the control electronics for a light source of the control cabinet lamp 1 can be taken up. The control cabinet lamp 1 can have a circuit board with a plurality of LEDs or OLEDs as a light source, for example, which are arranged in the light fixture 18 underneath a transparent cover, wherein the circuit board is connected electrically to the control electronics in the lamp base 2. The lamp base 2 also has a socket insert 17, in order to provide a voltage supply for another power consumer, for example to connect a service unit (e.g. laptop, diagnosis unit etc.) in the event of servicing.

The control cabinet lamp 1 can be placed via its contact side 5, which is a base side of the lamp base 2, on a support, for example a control cabinet rack, a flat part of a control cabinet or a mounting plate, but also facing the control cabinet interior on a bottom plate of a roof-mounted cooling unit and mounted thereon by way of the first attachment means 6.

In the diagram shown in FIG. 1, the pivot arm 4 with its first attachment means 6 formed as a mounting flange protrudes from a receptacle in the lamp base 2. The mounting flange 6 has a through-hole to fix the mounting flange on the support with the aid of a bolt. The second attachment means (7, see FIG. 2), which is not recognizable in the diagram according to FIG. 1, is taken up in the receptacle 3.

The locking piece 10 is located in its position slid fully into the recess 9, which represents a locking position, in which the pivot arm 4 is fixed in the first setting position shown and is pretensioned if necessary in the first setting position. It is also to be recognized that the locking piece 10, which is inserted into the lamp base 2 via a recess 9 formed in the side wall 8 of the lamp base 2, at least proportionally closes both the recess 9 on the side wall 8 and an access 25 on the end face 26 of the lamp base 2. The locking piece 10 thus protrudes through the recess 9 into the receptacle 3 of the lamp base 2 and interacts in such a way with the second attachment means (7, not shown) located in the receptacle 3 that the pivot arm 4 is fixed in the first setting position shown. To this end the locking piece 10 can have a receptacle, for example a form-fit receptacle, in which the second attachment means (7, not shown) is taken up in the locking piece 10 at least proportionally in a form-fit manner in the locking position shown.

By analogy with FIG. 1, FIG. 2 shows the pivot arm 4 in the second setting position, so that this protrudes with its second attachment means 7 from the receptacle 3. The first attachment means 6 is recognizably taken up at least proportionally in an attachment means receptacle (29) (cf. FIG. 6) of the locking piece 10, so that the pivot arm 4 is locked in the second setting position shown. The attachment means receptacle (29) of the locking piece 10 can be formed so that it acts upon the pivot arm 4 with pretensioning in the direction of the second setting position shown, for example to promote contact of the pivot arm 4 with the support on which the control cabinet lamp 1 is mounted, or to guarantee a secure seating of the control cabinet lamp 1 on the support.

In the diagram according to FIG. 3, the locking piece 10 is located in its release position, it therefore protrudes from the receptacle 9 above the side wall 8, at least so far that free pivoting of the pivot arm 4 is possible between the setting positions.

It is also recognized from FIG. 3 that if the locking piece 10 is located in the release position, in particular the access 25 on the end face 26 of the lamp base 2 is open, it is therefore no longer closed by the locking piece 10 so that, starting from the situation according to FIG. 3, the first attachment means 6 can be pivoted out of the lamp base 2 via the access 25 in the end face 26, for example, in order to transfer the pivot arm 4 into the first setting position according to FIG. 1.

Figure 4:
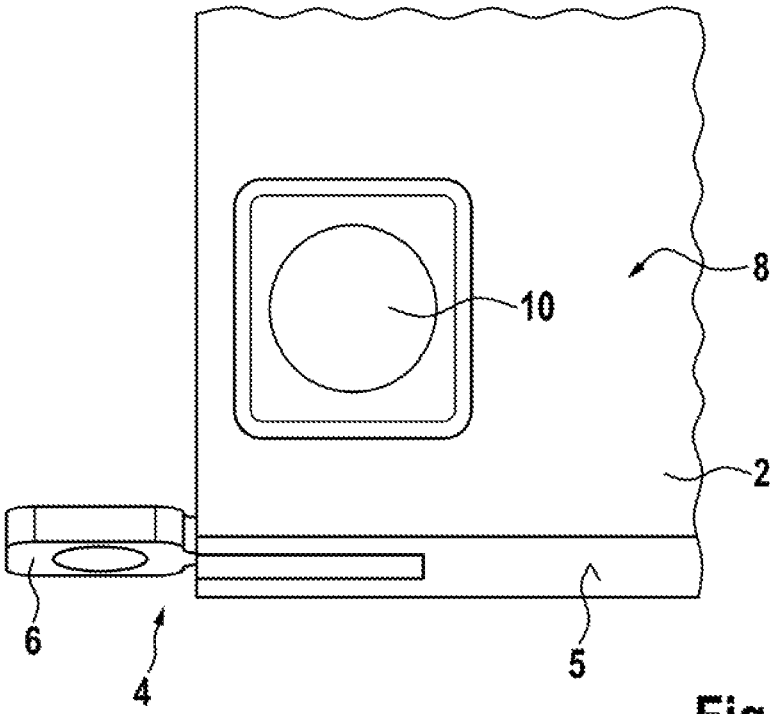
FIG. 4 shows a detailed view of a device base of another embodiment formed as a lamp base, wherein the pivot arm is located in its first setting position.
Figure 5:
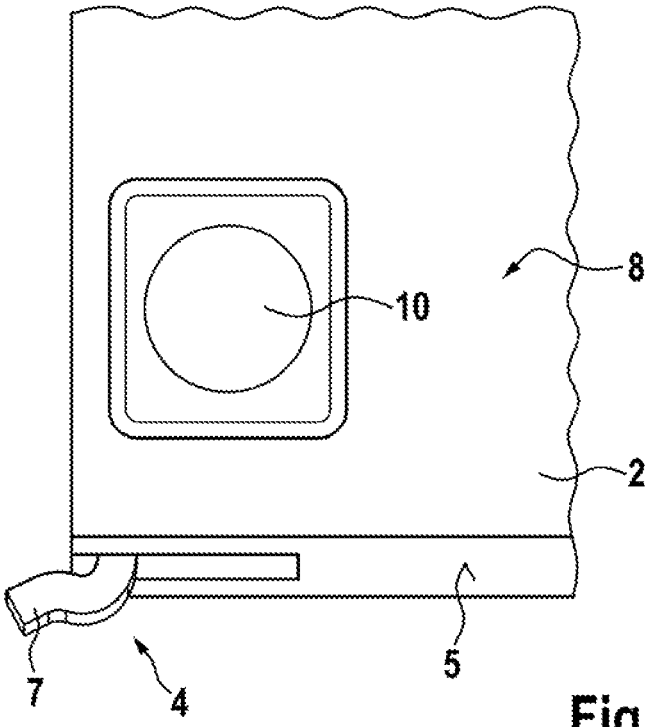
FIG. 5 shows the view according to FIG. 4, wherein the pivot arm is located in its second setting position.

FIGS. 4 and 5 illustrate once more in detail that in the two locked setting positions only the first or the second attachment means 6, 7 respectively protrudes from the lamp base 2 and all constituents of the pivot arm 4 beyond this, in particular the other attachment means 6, 7 are completely taken up in the lamp base 2.

Figure 6:
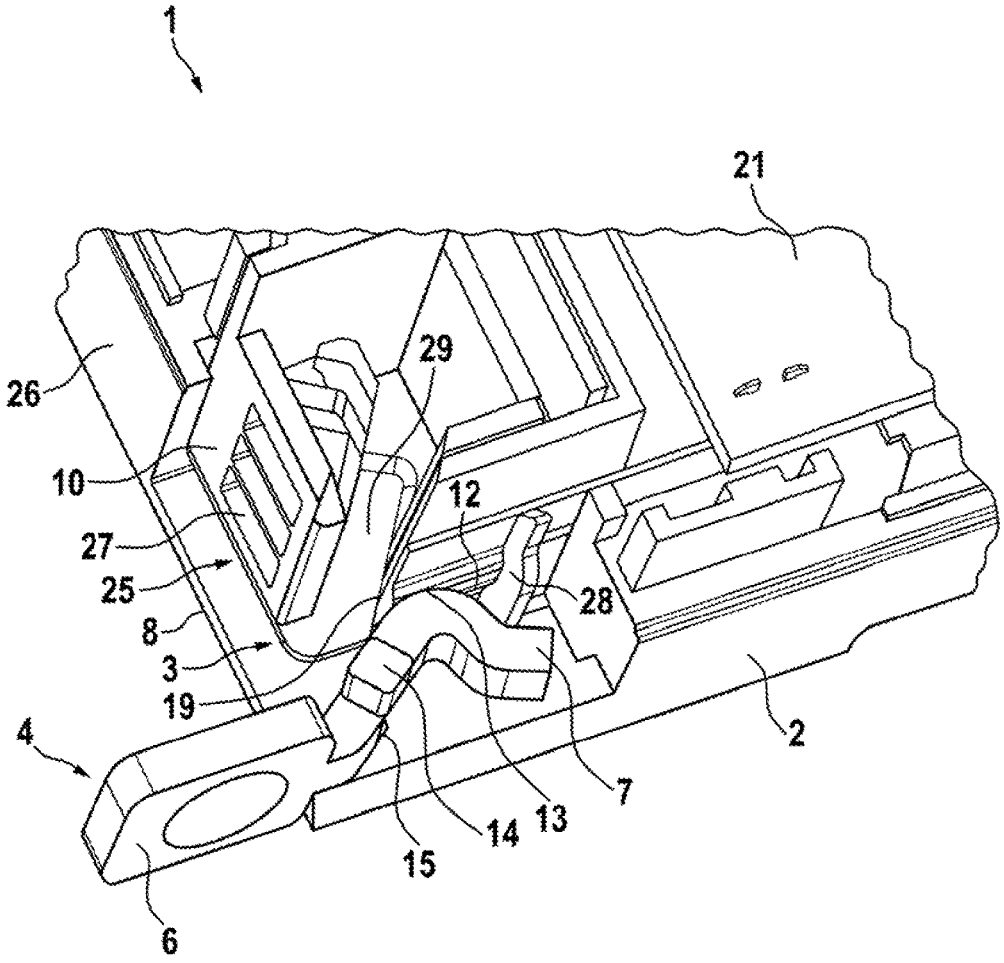
FIG. 6 shows in a representation in perspective a truncated view of a lamp base of another embodiment of a control cabinet lamp.

The detailed view of FIG. 6 shows in particular the interaction of the pivot arm 4 and the locking piece 10 and a contact 12 for the equipotential bonding. In the diagram according to FIG. 6, the pivot arm 4 is located in a first setting position, in which the pivot arm 4 protrudes with its first attachment means 6 (cf. FIG. 1) from the receptacle 3 in the lamp base 2. The locking piece 10 is located in its locking position. In this the locking piece 10 presses with one shoulder 19 against the pivot arm 4, so that this is pretensioned in the first setting position. The movement of the pivot arm 4 is further limited by a counterholder 28 forming a stop. It is to be recognized that the second attachment means 7 is not taken up in an attachment means receptacle of the locking piece 10 in the locking position shown.

The pivot axis of the pivot arm 4 is formed by two opposing bearing extension pieces 14, which are taken up in bearing receptacles 15 (only one bearing receptacle 15 is shown) on the opposing insides of the lamp base 2. The pivot arm 4 contacts with a contact ridge 13 an electrical contact 12, which is connected electrically to the circuit board 21, so that the circuit board 21 is earthed via the pivot arm 4 relative to the support on which the control cabinet lamp 1 is mounted.

The locking piece 10 has a grooved profile 27, which is accessible via the access 25 on the end face 26 of the lamp base 2 and is used to move the locking piece 10 out of the locking position shown, for example with the aid of a flathead screwdriver, into the release position.

Figure 7:
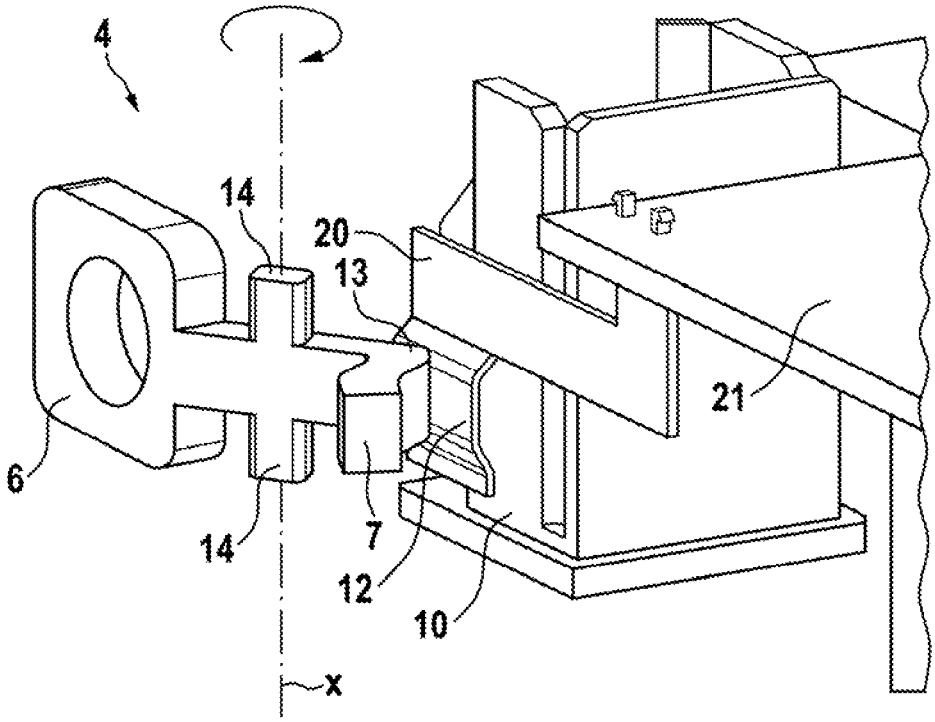
FIG. 7 shows another detailed view of the control cabinet lamp according to FIG. 6, wherein the lamp base has been omitted for a clearer visualization.

The contacting of the circuit board 21 with the pivot arm 4 is shown in detail in FIG. 7. The pivot arm 4 is pivotable about its pivot axis x. In the setting position shown in FIG. 7, the pivot arm 4 rests with its contact ridge 13 on an electrical contact 12 in the lamp base 2. The contact 12 is connected electrically via a conductor path 20 to the circuit board 21.

Figure 8:
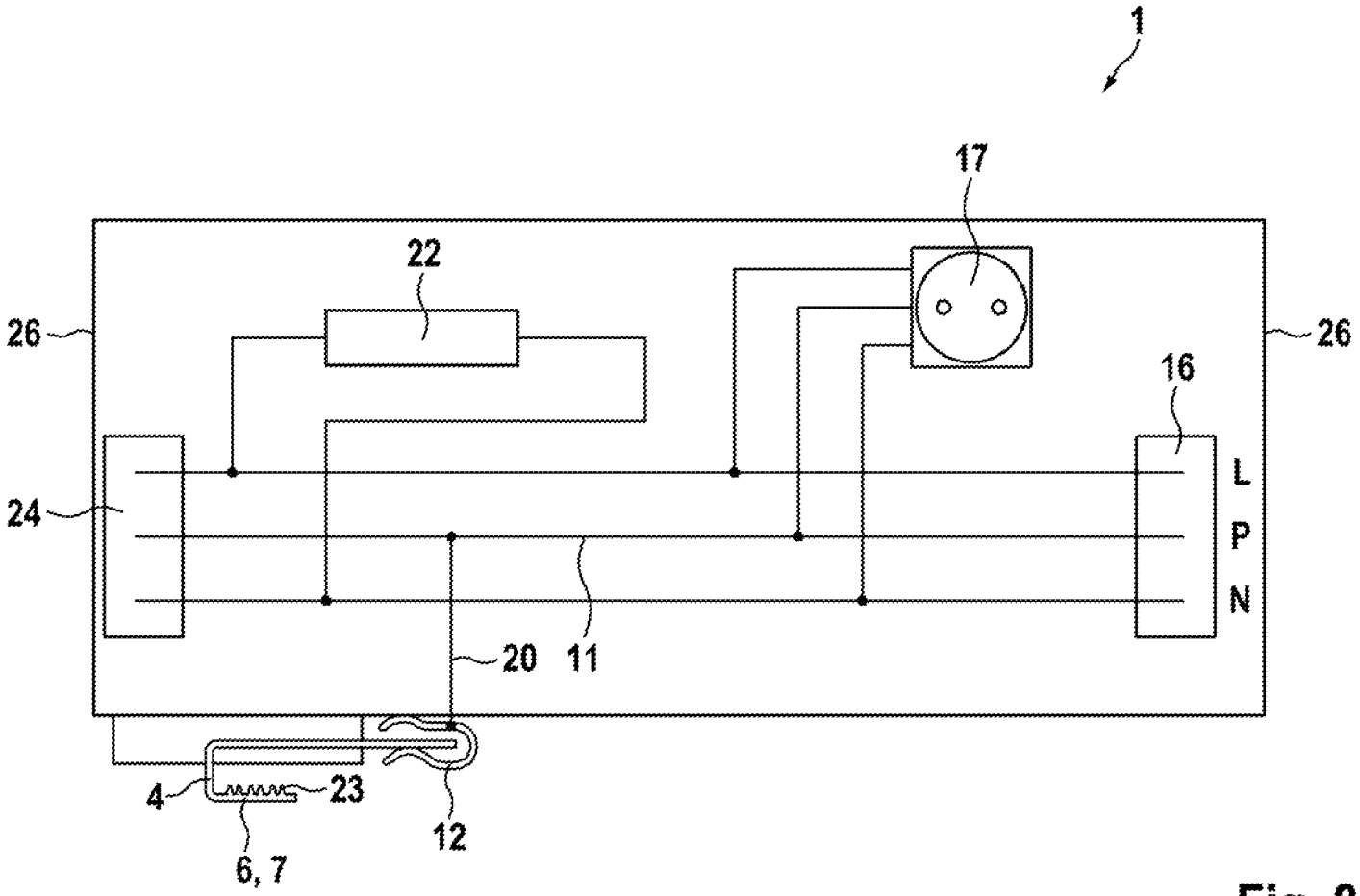
FIG. 8 shows schematically a possible equipotential bonding between the pivot arm and the protective conductor of the control cabinet lamp.

For further visualization of the contacting, a control cabinet lamp is shown schematically in FIG. 8, in which the first or the second attachment means 6, 7 has contact claws 23, via which the respective attachment means 6, 7 electrically contacts the base on which the control cabinet lamp 1 is mounted. The pivot arm 4 is in electrical contact with the protective conductor 11 via a contact 12 and a conductor path 20.

The control cabinet lamp 1 shown in FIG. 8 has on opposing end faces 26 a plug connector 16 for the network connection and a modular plug connector 24, via which the control cabinet lamp 1 can be connected in series to at least one other control cabinet lamp 1 or to a plurality of the control cabinet lamps 1 shown in FIG. 8. In particular, the plug connector 16 and the modular plug connector 24 can be formed identically. In the modular situation the direct contacting of the looped-through protective conductor shown in FIG. 8 has the advantage that adequate equipotential bonding according to standard specifications is provided thereby, even if a plurality of the lamps shown in FIG. 1 are connected in series, in particular if more than three of the control cabinet lamps 1 shown in FIG. 8, which each have a socket insert 17, are connected in series.

The features of the invention disclosed in the present description, in the drawings and in the claims can be substantial for the realization of the invention both individually and in any combination.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. An electronic device comprising a device base for mounting the electronic device on a support, wherein at least one pivot arm is partially taken up in a receptacle of the device base and partially protrudes from the device base, which arm is adjustable about a pivot axis parallel to a contact side of the device base, wherein in a first setting position of the pivot arm a first attachment means is arranged outside the receptacle, and wherein in a second setting position of the pivot arm a second attachment means differing from the first attachment means is arranged outside the receptacle, wherein a recess opening into the receptacle is formed on a side wall of the device base, into which a locking piece is inserted, which is adjustable parallel to the pivot axis between a release position, in which it releases the pivot arm, and a locking position, in which it fixes the pivot arm optionally in the first or the second setting position.

2. The electronic device according to claim 1, in which the first attachment means for the tool-dependent attachment of the electronic device is formed in particular as a bolt receptacle, and in which the second attachment means for the tool-free attachment of the electronic device is formed in particular as a hook element.

3. The electronic device according to claim 1, in which the pivot arm is manufactured from an electrically conductive material, in particular from a metal, and is connected electrically to a protective conductor of the electronic device.

4. The electronic device according to claim 3, in which the pivot arm, at least in the first and the second setting position, electrically contacts a contact in the receptacle of the device base, which contact is electrically connected to a protective conductor.

5. The electronic device according to claim 4, in which a contact ridge of the second attachment means electrically contacts the contact if the pivot arm is located in the first setting position and the first attachment means is arranged outside the receptacle.

6. The electronic device according to claim 1, in which the pivot arm has two opposing bearing extension pieces, which engage respectively in a bearing receptacle in the device base and form the pivot axis.

7. The electronic device according to claim 6, in which the first and the second attachment means are formed opposingly on the pivot axis perpendicular to the pivot axis.

8. The electronic device according to claim 1, in which one of the attachment means is substantially an S-shaped hook element and the other is an attachment eye.

9. The electronic device according to claim 1, in which the locking piece assumes a latching position in the locking position and presses the pivot arm with pretensioning into the fixed setting position.

10. The electronic device according to claim 1, in which the locking piece acts in the locking position on the attachment means of the pivot arm that is arranged inside the receptacle.

11. The electronic device according to claim 1, in which the locking piece closes at least the recess in the side wall and an access to the receptacle in an end face of the device base, via which the pivot arm protrudes from the device base, in the locking position.

12. The electronic device according to claim 1, in which the pivot arm can be fixed via the locking piece in at least two different locking positions.

13. An electronic device according to claim 1, which is a control cabinet lamp for mounting in the interior of a control cabinet, wherein the device base is a lamp base of the control cabinet lamp.

* * * * *